United States Patent [19]

Schulze-Beckinghausen

[11] Patent Number: 5,044,232

[45] Date of Patent: Sep. 3, 1991

[54] ACTIVE JAW FOR A POWER TONG

[75] Inventor: Joerg E. Schulze-Beckinghausen, Garbsen, Fed. Rep. of Germany

[73] Assignee: Weatherford U.S., Inc., Houston, Tex.

[21] Appl. No.: 442,542

[22] Filed: Nov. 28, 1989

[30] Foreign Application Priority Data

Dec. 1, 1988 [GB] United Kingdom ..... 8828087

[51] Int. Cl.[5] ..... B25B 13/50

[52] U.S. Cl. ..... 81/57.18; 81/57.21; 81/57.33

[58] Field of Search ..... 81/57.13, 57.14, 57.15, 81/57.16, 57.17, 57.18, 57.19, 57.20, 57.30, 57.33, 57.34

[56] References Cited

U.S. PATENT DOCUMENTS

| | | | |
|---|---|---|---|
| 2,181,641 | 11/1989 | Hicks . | |
| 3,131,586 | 5/1964 | Wilson . | |
| 3,261,241 | 7/1966 | Catland | 81/57.18 |
| 3,589,742 | 6/1971 | Flick | 81/57.18 |
| 3,625,095 | 12/1971 | Barnett et al. . | |
| 3,635,105 | 1/1972 | Dickmann et al. | 81/57.18 |
| 3,847,040 | 11/1974 | Bufkin . | |
| 3,875,826 | 4/1975 | Dreyfuss et al. | 81/57.18 |
| 4,084,453 | 4/1978 | Eckel | 81/57.18 |
| 4,192,206 | 3/1980 | Schulze-Beckinghausen | 81/57.18 |
| 4,246,809 | 1/1981 | Keast et al. . | |
| 4,250,773 | 2/1981 | Haynes et al. | 81/57.18 |
| 4,273,010 | 6/1981 | Farr et al. | 81/57.18 |
| 4,290,304 | 9/1981 | Eckel | 81/57.18 |
| 4,333,365 | 6/1982 | Perry . | |
| 4,346,629 | 8/1982 | Kinzbach | 81/57.15 |
| 4,372,026 | 2/1983 | Mosing | 81/57.14 |
| 4,404,876 | 9/1983 | Eckel | 81/57.18 |
| 4,631,987 | 12/1986 | Buck . | |
| 4,688,453 | 8/1987 | Schulze-Beckinghausen | 81/57.13 |
| 4,827,808 | 5/1989 | Haynes et al. . | |
| 4,836,064 | 6/1989 | Slator | 81/57.18 |

FOREIGN PATENT DOCUMENTS

| | | |
|---|---|---|
| 0082099 | 6/1983 | European Pat. Off. . |
| 0311455 | 4/1989 | European Pat. Off. . |
| 981569 | 1/1965 | United Kingdom . |
| 1226860 | 3/1971 | United Kingdom . |
| 1348954 | 3/1974 | United Kingdom . |
| 1350171 | 4/1974 | United Kingdom . |
| 1452524 | 10/1976 | United Kingdom . |
| 1515220 | 6/1978 | United Kingdom . |
| 2049517 | 12/1980 | United Kingdom . |
| 2084062 | 4/1982 | United Kingdom . |
| 2100639 | 1/1983 | United Kingdom . |

OTHER PUBLICATIONS 1988-89 General Services and Product Catalog for Weatherford International Incorporated.

1988 Annual Report-Weatherford International Incorporated.

*Primary Examiner*—D. S. Meislin

*Attorney, Agent, or Firm*—Guy McClung

[57] ABSTRACT

An active jaw for a power tong is provided with an upper cam and a lower cam which are shaped so that rotation of the rotary relative to the active jaw in either sense from a first position results in the active jaw being applied to a pipe via a roller. The active jaw can be released by reversing the direction of rotation of the rotary. A peg may be used to limit movement of the active jaw relative to the rotary to prevent the active jaw being reapplied to the pipe. Pipes of different diameters may be gripped by using rollers of different diameters and, optionally, different active jaws shaped to grip the pipe. In a second embodiment a brake band acts on a drum which supports the active jaw. When the rotary is started the active jaw is restrained from rotation. This relative movement applies the dies on the active jaw to the pipe. Further rotation of the rotary then overcomes the braking force and the rotary, drum and active jaw rotate in unison. An adjustment bolt is provided to prevent the active jaw being reapplied when the rotary is reversed.

7 Claims, 5 Drawing Sheets

61
27
20
40
39
19
34
28
29
35
30
18
25
67
23
31
36
4
17

ACTIVE JAW FOR A POWER TONG

BACKGROUND OF THE INVENTION

1. Field of the Invention

This invention relates to an active jaw for a power tong, a power tong including such an active jaw and a method of changing the capacity of such a power tong.

2. Description of Related Art

During the construction of an oil or similar well it is necessary to connect successive lengths of pipe. This is achieved by a threaded connection.

Conventionally, a tool known as a power tong is used for gripping one length of pipe and rotating it relative to the next to make or break the joint.

Known power tongs comprise a body, a rotary rotatably mounted in said body and at least one active jaw which, on rotation of the rotary is cammed against a pipe in the rotary and grips it for rotation with the rotary.

In known arrangements the camming action is generated by a cam member which is bolted to the rotary and is shaped so that the active jaw will be cammed against the pipe on rotation of the rotary relative to the active jaw in one sense and will be released on rotation of the rotary relative to the active jaw in the opposite sense.

In order to reverse the screwing direction of one known power tong with only one active jaw, the active jaw must be removed and remounted on the opposite side of the rotary. On rotation of the rotary relative to the active jaw in the opposite sense the active jaw is cammed against the pipe by a second cam member. This is a time-consuming process. Furthermore, the power tong must be removed from the pipe to enable the active jaw to be moved.

In another known power tong two cam members are bolted to the rotary. When the rotary is rotated relative to the active jaw in either direction from a neutral position the active jaw is applied to the pipe.

Another problem with known arrangements is that they can only be used in relation to a very limited range of pipe sizes. Outside of this range the jaws do not grip the pipe properly and, as a result, the surface of the pipe becomes damaged.

One solution to this problem has been to use different cam members for gripping pipes of different sizes. However, removing and replacing cam members is a time-consuming exercise. Furthermore, the range of pipe sizes which can be gripped satisfactorily cannot be substantially increased by this method.

SUMMARY OF THE INVENTION

According to the present invention there is provided an active jaw for a power tong having a rotary, wherein said jaw is provided with a first cam surface which, in use, urges said active jaw against a pipe when said rotary is rotated in one sense from a first position, and a second cam surface which, in use, urges said active jaw against said pipe when said rotary is rotated in the opposite sense from the first position.

It will be noted that, in contrast to the prior art, the first and second cam surfaces are disposed on the active jaw.

Advantageously, said first cam surface and said second cam surface comprise part of a first cam.

Preferably, the active jaw is provided with a second cam which has a first cam surface and a second cam surface which correspond to the first cam surface and the second cam surface of said first cam and, in use, is vertically spaced therefrom.

In one embodiment, said active jaw is provided with a top plate having a handle for manipulating said active jaw.

The present invention also provides a power tong provided with an active jaw in accordance with the invention.

In a particularly preferred embodiment the active jaw is movably mounted on a first piece which is fast with the rotary.

Preferably, a roller is rotatably mounted on said first piece for engaging said first and second cam surfaces.

During a coupling operation the rotary is normally rotated clockwise and this motion causes the active jaw to be cammed against the pipe. At the end of the coupling operation the rotary is reversed to release the active jaw. It will be appreciated that if the rotary is rotated excessively relative to the active jaw the active jaw will be reapplied to the pipe. In order to inhibit this occurring, means are preferably provided to limit movement of the active jaw relative to the rotary.

Advantageously, said means comprises a peg which can be located in said first piece.

Preferably, a bar is provided to inhibit separation of said active jaw and said first piece.

Advantageously, the power tong includes means to inhibit synchronous movement of said rotary and said active jaw to facilitate the application of said active jaw to a pipe.

Preferably, said means comprises a drum and a brake which is applied to said drum.

Advantageously, said active jaw is provided with a tongue and said drum is provided with a recess which receives said tongue, the arrangement being such that said active jaw can move radially of said power tong.

Preferably, said power tong includes a spring which is mounted on said drum and which urges said active jaw radially outwardly of said power tong.

Advantageously, said means to limit movement of the active jaw relative to the rotary comprises a bolt mounted in or on said brake and which can be moved to project into an opening in said brake, relative movement between said rotary and said active jaw being limited by engagement of said bolt with an extremity of said opening.

The present invention also provides a method of changing the capacity of a power tong in accordance with the invention, which method comprises the step of of replacing the roller with a roller of different diameter.

Preferably, said method also comprises the step of replacing said active jaw with an active jaw shaped to accommodate a pipe of different diameter.

Advantageously, said power tong comprises at least one passive jaw and said method further comprises the step of replacing said passive jaw with a passive jaw shaped to accommodate a pipe of different diameter.

According to another aspect of the present invention there is provided a power tong having a rotary, an active jaw, means to apply said active jaw to a pipe, and means to inhibit movement of said active jaw relative to said rotary, characterized in that said means comprises a brake member which carried said active jaw in a manner such that said active jaw is restrained against rotation by said brake member but can move radially of said power tong.

Preferably, said active jaw is provided with one or more cam surfaces and said means comprises one or more rollers. This arrangement has significant advantages over the prior art arrangement comprising a roller on the active jaw carrier and a cam on the rotary.

Advantageously, said brake member comprises a drum part of which is surrounded by a brake band.

Preferably, said active jaw is provided with a tongue and said drum is provided with a recess to accommodate said tongue.

Advantageously, a spring is provided to bias the active jaw outwardly.

BRIEF DESCRIPTION OF THE DRAWINGS

For a better understanding of the invention reference will now be made, by way of example, to the accompanying drawings, in which.

DESCRIPTION OF PREFERRED EMBODIMENTS

Figure 1:
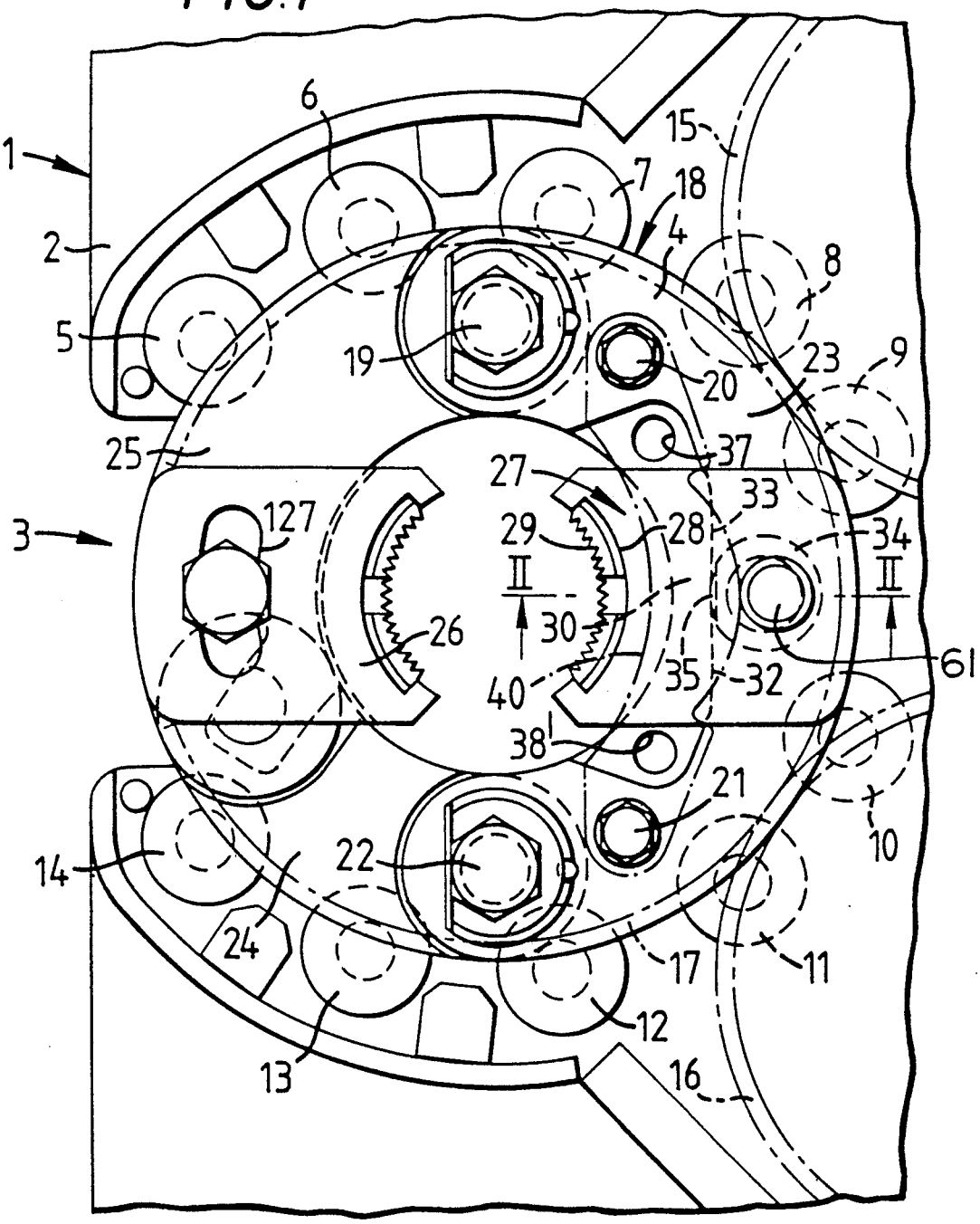
FIG. 1 is a plan view of part of one embodiment of a power tong incorporating an active jaw in accordance with the invention.

Referring to the drawings there is shown the front end of a power tong which is generally identified by reference numeral 1. The power tong 1 comprises a body 2 having an opening 3 through which a pipe can be introduced into the pipe receiving recess of a rotary 4.

The rotary 4 is rotatably supported in the body 2 by a plurality of rollers 5–14 and can be rotated by a hydraulic motor (not shown) acting through a gear train including gear wheels 15 and 16 which act on a toothed member 17 which extends around the periphery of the rotary 4 with the exception of the pipe receiving recess therein.

A jaw assembly 18 is mounted on the rotary 4 and is secured thereto by four bolts 19, 20, 21 and 22. The jaw assembly 18 comprises a first piece 23, a second piece 24 and a third piece 25. The second and third pieces 24 and 25 are pivotally mounted on bolts 22 and 19 and can be pivoted to a closed position as shown.

The third piece 25 carries a passive jaw 26 which is slidably mounted on the third piece 25 within the confines of a slot 127.

The first piece 23 carries an active jaw which is generally identified by reference numeral 27. The active jaw 27 comprises a recess 28 containing a die 29.

Figure 2:
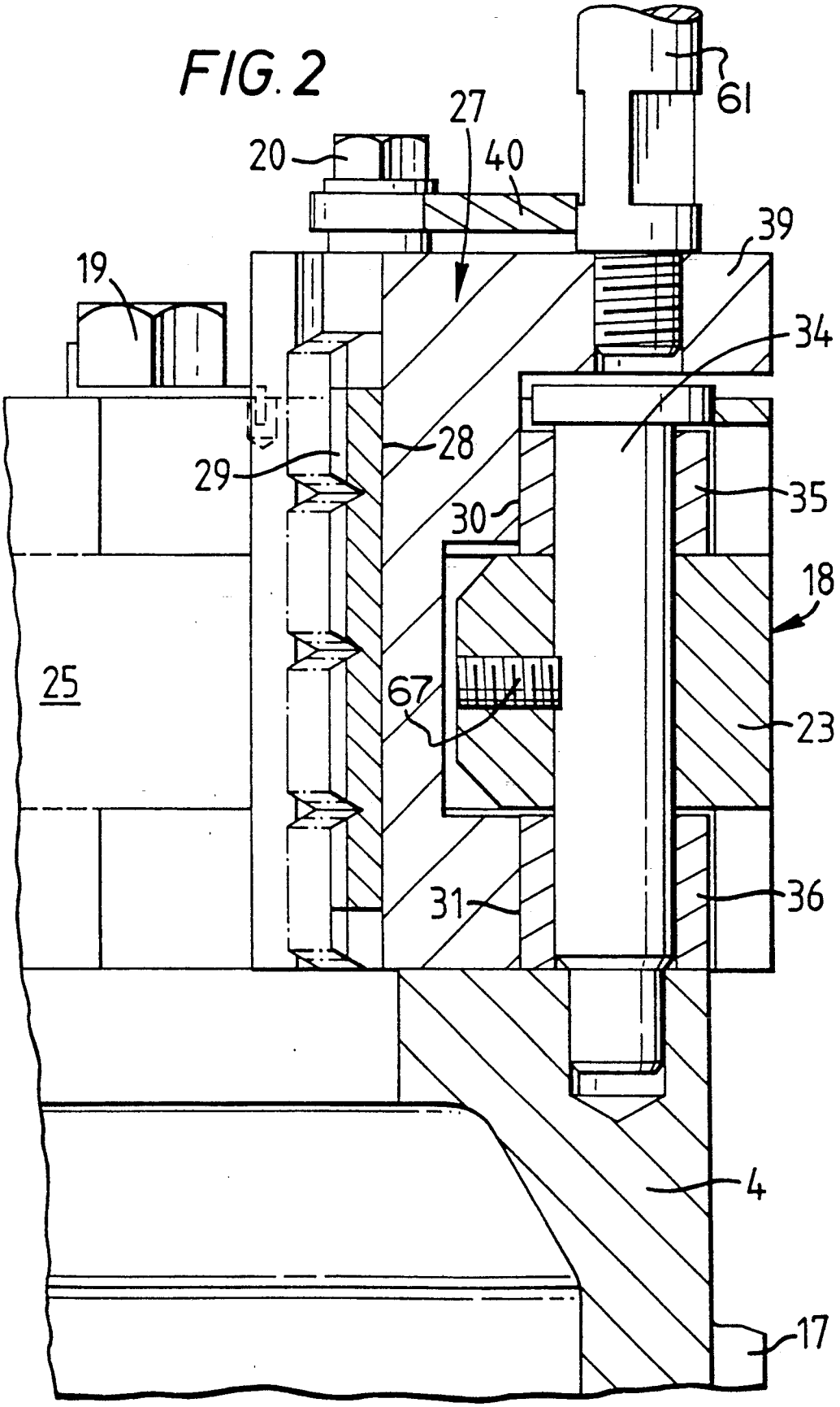
FIG. 2 is a section taken on line II—II of FIG. 1.

As better shown in FIG. 2, the active jaw 27 is provided with an upper cam 30 and a lower cam 31. Both the upper cam 30 and the lower cam 31 are provided with corresponding first and second cam surfaces. As shown in FIG. 1, the upper cam 30 has a first cam surface 32 and a second cam surface 33.

A pin 34 extends through the first piece 23 into the top of the rotary 4 and supports two rollers 35 and 36. The pin 34 is prevented from rotating by a grub screw 37.

In use, the rotary 4 is first rotated until its pipe receiving recess (not shown) is aligned with the opening 3 in the body 2. The second and third pieces 24 and 25 are then swung open so that the power tong 1 can be manoeuvred into a position in which the pipe to be rotated is in the centre of the rotary 4. The third and second pieces 25 and 24 are then swung to their closed position as shown in FIG. 1.

The active jaw 27 is then gripped manually and hydraulic fluid admitted to the hydraulic motor to commence rotation of the rotary 4, for example clockwise as viewed in FIG. 1. Since the active jaw 27 is being restrained the rollers 35 and 36 move relative to the active jaw 27 from the first position shown in FIG. 1 to a second position on the first cam surface 32. Because of the shape of the second cam surface 32 the active jaw 27 is advanced towards the pipe so that the teeth of the die 29 firmly grip the pipe. Once the teeth have made good contact with the pipe the active jaw 27 need no longer be restrained by hand and, indeed, this step can be completely omitted when there is initial contact between the teeth in the active jaw and the pipe.

When the screwing operation is complete the direction of rotation of the rotary 4 is reversed thus moving the rollers 35 and 36 relative to the first cam surface 32 towards the first position shown in FIG. 1.

It will be noted from FIG. 1 that the first piece 23 is provided with two bores 37 and 38'. A peg (not shown) can be inserted in either bore 37 or bore 38' to limit movement of the active jaw 27 with respect to the first piece 23. In the present case the peg is inserted in bore 37 so that movement of the active jaw 27 relative to the first member 23 stops when the active jaw 27 engages the peg in bore 37.

If it is desired to uncouple a joint the peg in bore 37 is simply removed thereby allowing the active jaw 27 to move into gripping engagement with the pipe on anticlockwise rotation of the rotary relative to the active jaw 27.

Similarly, when it is desired to release the pipe the peg is inserted in bore 38' and rotary 4 is rotated clockwise.

In order to prevent the active jaw 27 becoming detached from the jaw assembly 18 a bar 40 may be provided over the top plate 39 and a handle 61 mounted on the top plate 39. The bar 40 can conveniently be curved and secured to the first piece 23 via bolts and spacers. In the preferred embodiment bolts 20 and 21 pass through the bar 40, spacers and the first piece 23 and are screwed into the rotary 4.

The handle 61 limits horizontal movement of the active jaw 27 and can be used to restrain movement of the active jaw 27 relative to the first piece 23 during initial application of the active jaw 27. It can also be used to extract the active jaw 27 from a soft pipe when necessary.

Whilst the arrangement disclosed will work satisfactorily over a range of pipe sizes it will not apply sufficient pressure to adequately grip small diameter pipes. In order to accommodate such pipes the passive jaw 26, active jaw 27 and the rollers 35 and 36 are first removed. Larger diameter rollers are then installed and appropriately shaped active and passive jaws fitted.

It will be noted that the point of contact between the larger diameter roller and the active jaw is closer to the centre of the power tong. This is highly desirable.

Figure 3:
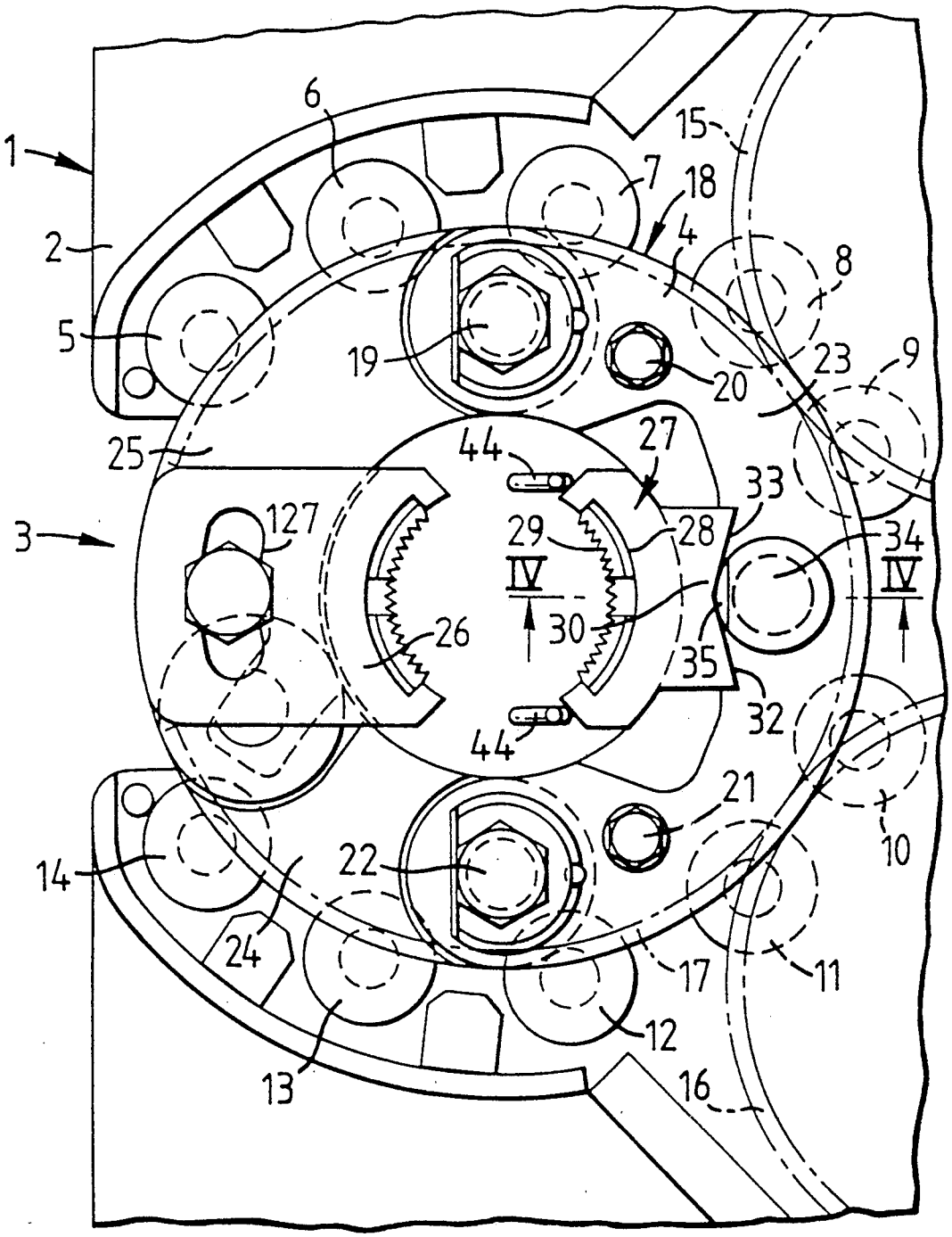
FIG. 3 is a plan view of a second embodiment of a power tong incorporating an active jaw in accordance with the invention.
Figure 4:
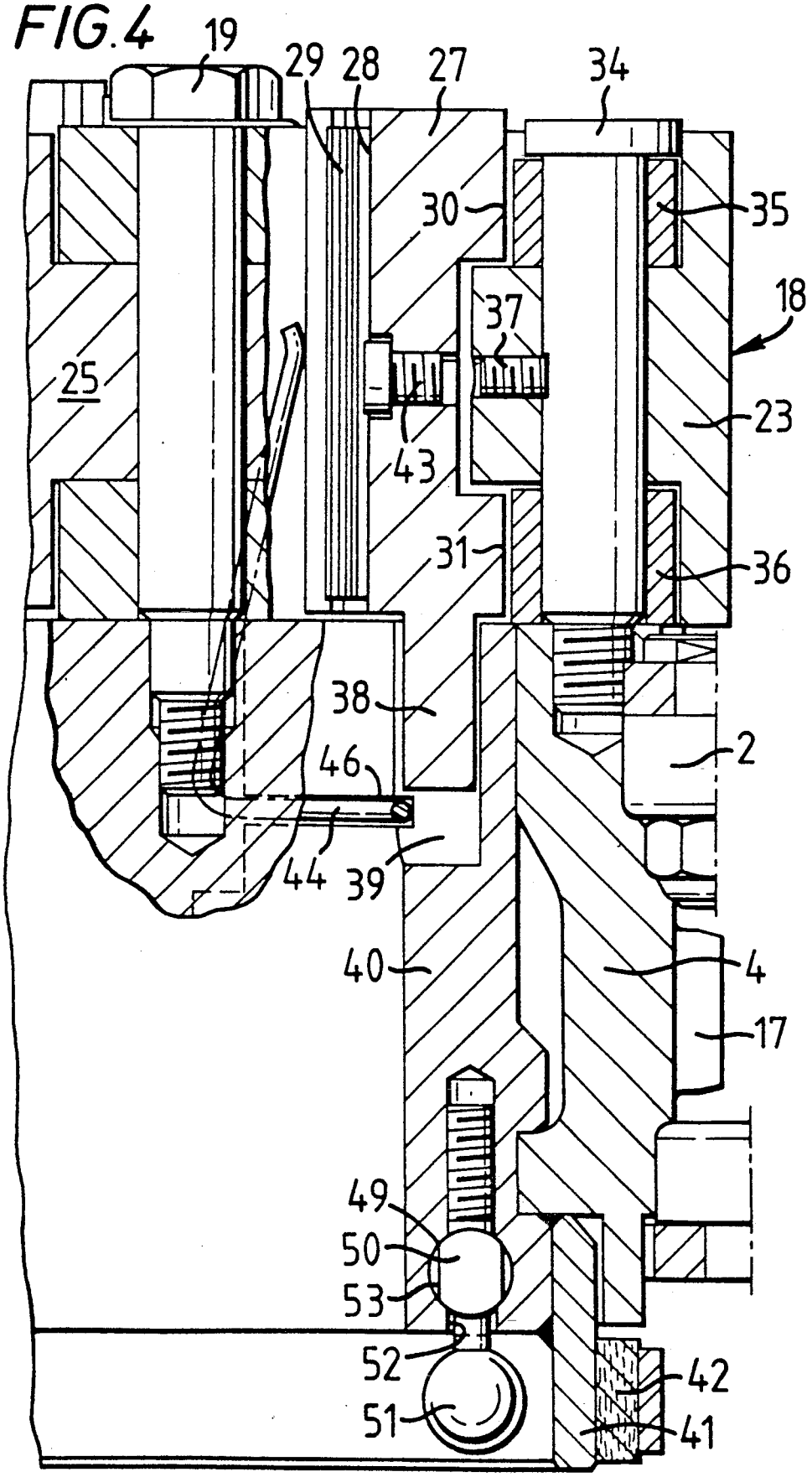
FIG. 4 is a section taken on line IV—IV of FIG. 3.
Figure 5:
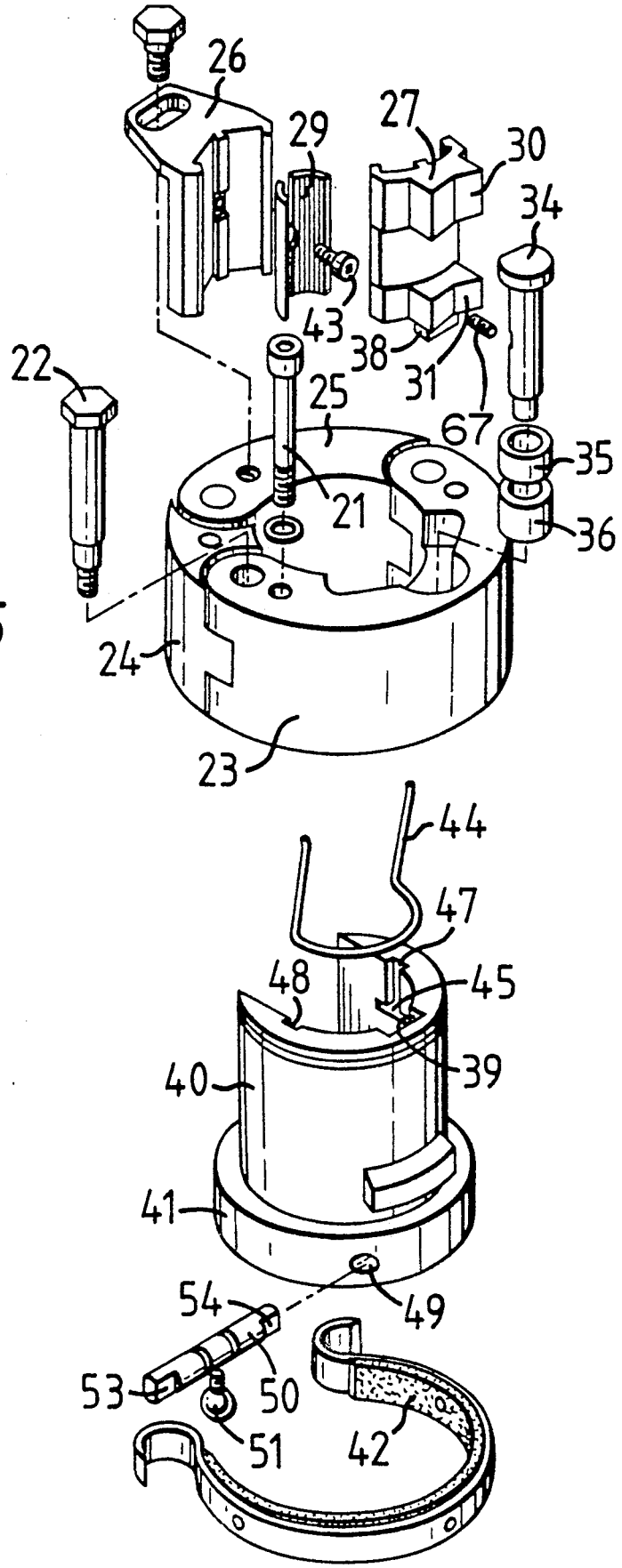
FIG. 5 is an exploded view showing some of the parts of the embodiment shown in FIGS. 3 and 4.

It will be noted that in the embodiment thus far described manual force may be necessary to initially apply the active jaw 27 to the pipe. Whilst this is satisfactory for gripping large diameter pipes manual force may not be sufficient to initiate gripping small diameter pipes. FIGS. 3 to 5 describe one solution for overcoming this problem. In FIGS. 3 to 5 parts having similar functions to parts in the embodiment in FIGS. 1 and 2 have been identified by the same reference numerals.

Referring to FIGS. 4 and 5, the bottom of the active jaw 27 is provided with a tongue 38 which fits snugly in a recess 39 in a drum 40. The drum 40 has a skirt 41 which is surrounded by a brake band 42 which is secured fast to the body 2 of the power tong.

The die 29 is secured to the active jaw 27 by a bolt 43 and the unit thus formed is biased towards rollers 35 and 36 by a strong spring 44 which is mounted in a groove 45 in the drum 40. The grove 45 has a circumferential portion 46 and two upwardly extending portions 47 and 48 which can best be seen in FIG. 5.

In use, rotary 4 is rotated in one sense, for example anti-clockwise as viewed in FIG. 3, via toothed member 17. Since first piece 23 is bolted to rotary 4 it also rotates anti-clockwise. However, drum 40, and consequently active jaw 27, are constrained against rotation by brake band 42. As first piece 23 rotates relative to active jaw 27 the rollers 35 and 36 move along second cam surface 33 which, in this embodiment, has a pronounced angle. As this happens the die 29 moves inwardly and securely grips the pipe. As the rotary 4 moves further clockwise the force exerted by the rollers 35 and 36 on the second cam surface 33 of the active jaw 27 is sufficient to overcome the force applied by the brake band 42 and the rotary 4, jaw assembly 18 and drum 40 rotate in unison.

When the rotary 4 is turned clockwise the pipe is released. However, to prevent the active jaw 29 being driven back into engagement with the pipe the skirt 41 of the drum is provided with a bore 49. A bolt 50 is slidably mounted in bore 49 and can be slid along the bore 49 by a knob 51 which projects through a slot 52. The ends of the bolt 50 are provided with flats 53 and 54 and, in the present case, flat 53 projects outwardly from the bore 49 into a slot (not shown) in the rotary 4. When the rotary 4 rotates clockwise it moves relative to the drum 40 until the flat 53 engages the end of the slot. This corresponds to rollers 35 and 36 contacting the centre of the active jaw 27.

In order to reverse the direction of rotation of the pipe the bolt 50 is slid until the flat 54 projects from the other end of the bore 49 into a second slot (not shown) in the rotary 4. The second slot does not inhibit the die 29 being driven into gripping and rotating engagement with the pipe. It does, however, limit relative movement between the active jaw 27 and the rollers 35, 36 when the direction of rotation of rotary 4 is reversed.

Various modifications to the arrangements described are envisaged. Thus, whereas the preferred embodiments have been described in combination with a jaw assembly 18 which is mounted ON rotary 4 jaws in accordance with the invention can also be used with conventional tongs in which the jaws are mounted IN the rotary. Furthermore, the active jaw 27 shown in FIGS. 3, 4 and 5 could be provided with a top plate 39 and handle 41 to facilitate extraction of the die 29 from a soft pipe. The slot (not shown) in the drum 40 could also comprise a recess, hole or other form of opening if desired.

What is claimed is:

1. An active jaw for a power tong, the power tong having a rotary movably mounted in a body and rotation means interconnected with the rotary for rotating the rotary, the power tong having a drum attached to the rotary, the drum having a drum recess for receiving and holding a jaw tongue, the drum recess conforming in shape to the jaw tongue, and a brake applicable to the drum to inhibit synchronous movement of the rotary and the active jaw to facilitate the application of the active jaw to a pipe to be gripped and rotated by the power tong, the active jaw movable radially of the pipe and movably connected to the rotary, the active jaw comprising a jaw body disposed above the drum, a first cam surface on the jaw body for reacting with a cam member attached to the rotary to urge the active jaw against the pipe upon rotation of the rotary in a first direction, a second cam surface on the jaw body for reacting with the cam member to urge the active jaw against the pipe upon rotation of the rotary in a second direction opposite the first direction, the active jaw having a tongue in the drum recess, the drum recess holding the tongue so that the jaw moves with the drum, the tongue extending generally parallel to the pipe.

2. A power tong for gripping and rotating pipe, the power tong comprising a body having a body pipe receiving recess, a rotary rotatably mounted in the body on a plurality of rollers, the rotary having a rotary pipe receiving recess therein alignable with the body pipe receiving recess, the rotary rotatable in a first direction or in a second direction opposed to the first direction, rotation means interconnected with the rotary for rotating the rotary, an active jaw movably connected to the rotary and camming means for cammed movement of the active jaw, the camming means having a first cam surface and a second cam surface on said active jaw, rotatable roller means connected to the rotary and contactable by the camming means for reacting with the camming means to move the active jaw, the active jaw movable radially with respect to the pipe, reaction of the first cam surface with the roller means urging the active jaw against the pipe upon rotation of the rotary in the first direction, reaction of the second cam surface with the roller means urging the active jaw against the pipe upon rotation of the rotary in the second direction, braking means mounted in the body for inhibiting synchronous movement of the rotary and the active jaw to facilitate urging the active jaw against the pipe, the braking means comprising, a drum mounted in the body and a braking member mounted in contact and against the drum, the active jaw disposed above the drum, and the active jaw having a tongue extending into a drum recess in the drum, the drum recess conforming in shape to the jaw and holding the tongue so that the jaw moves with the drum, the tongue generally parallel to the pipe.

3. The power tong of claim 2 wherein the camming means includes a first cam having said first cam surface and a second cam surface.

4. The power tong of claim 3 wherein the camming means includes a second cam vertically spaced from the first cam and having a third cam surface vertically aligned with the first cam surface of the first cam and a fourth cam surface vertically aligned with the second cam surface of the first cam.

5. The power tong of claim 2 including a handle secured to and extending upwardly from the active jaw for manipulating it.

6. The power tong of claim 2 including a spring mounted on the drum and urging the active jaw radially outward of the tong.

7. The power tong of claim 2 including limit means for limiting movement of the active jaw relative to the rotary, the limit means comprising, a bolt mounted in the drum and movable to project into an opening in the rotary, relative movement between the rotary and the active jaw limited by engagement of the bolt with an extremity of the opening.

* * * * *